US005156029A

United States Patent [19]

Heald

[11] Patent Number: 5,156,029

[45] Date of Patent: Oct. 20, 1992

[54] LOCK AND PROTECTIVE COVER ASSEMBLY

[76] Inventor: Charles J. Heald, 137 River Village Cir., Dayton, Nev. 89403

[21] Appl. No.: 568,794

[22] Filed: Aug. 17, 1990

[51] Int. Cl.[5] ..... E05B 67/38

[52] U.S. Cl. ..... 70/55; 215/321; 220/306; 411/353; 411/512

[58] Field of Search ..... 70/54–56; 215/321; 220/306, 307, 356; 411/353, 512

[56] References Cited

U.S. PATENT DOCUMENTS

| | | | |
|---|---|---|---|
| 899,732 | 9/1908 | Hicks | 215/321 |
| 1,662,612 | 3/1928 | Junkunc | 70/55 |
| 1,663,799 | 3/1928 | Junkunc | 70/52 |
| 2,706,065 | 4/1955 | Stone | 220/307 |
| 2,718,980 | 9/1955 | Strom | 220/306 |
| 3,858,419 | 1/1975 | Hampton | 70/55 |
| 3,983,725 | 10/1976 | Manuel et al. | 70/55 |
| 4,218,902 | 8/1980 | Druschel | 70/55 |
| 4,224,813 | 9/1980 | Hampton | 70/55 X |
| 4,279,358 | 7/1981 | Jacobs | 220/306 X |
| 4,292,876 | 10/1981 | De Graan | 411/542 |
| 4,297,861 | 11/1981 | Dykes | 70/55 |
| 4,300,370 | 11/1981 | Kaiser et al. | 70/54 |
| 4,317,344 | 3/1982 | Barnard | 70/55 |
| 4,345,447 | 8/1982 | Keung et al. | 70/38 A |
| 4,651,543 | 3/1987 | Heald | 70/54 |
| 4,882,918 | 11/1989 | Stanich | 70/56 X |

FOREIGN PATENT DOCUMENTS

| | | | |
|---|---|---|---|
| 243672 | 11/1965 | Australia | 215/321 |
| 1351352 | 12/1963 | France | 220/307 |
| 1428577 | 1/1966 | France | 215/321 |
| 152664 | 12/1955 | Sweden | 220/307 |
| 192812 | 11/1964 | Sweden | 215/321 |

*Primary Examiner*—Lloyd A. Gall
*Attorney, Agent, or Firm*—John J. Posta, Jr.

[57] ABSTRACT

The assembly includes a lock with a main lock body having a bottom keyhole and an inverted u-shaped double rung top hasp connected to the top of the main body and extending upwardly therefrom. The assembly also includes a flexible, resilient, elastomeric protective lock cover removably enclosing and sealing the lock body against the elements. The cover is in two pieces. It includes a bottom portion extending over the lower sides of the lock body and continuing below the lock body. The bottom portion has opposed sides and a tapered bottom defining an openable closed slit through which, when opened, by squeezing opposed sides toward each other, the keyhole can be reached by a key. The cover also includes an upper cap having a top and interconnected depending sides. The inner surfaces of the cap sides bear a circumferential groove engageable with and of smaller diameter than the base of a circumferential bead with sloping top and bottom on the outer surface of the sides of the bottom portion. The groove and bead are horizontal and, when engaged, releasably hold the cap sealingly to the bottom portion. The top includes hasp holes into which downwardly projecting circumferential sealing extensions depend. The cover may be shaped to fit a flat, rectangular or square lock or a circular (in outline) lock and the cap top may include a hasp hole groove to facilitate movement of the free end of the hasp over the top.

13 Claims, 1 Drawing Sheet

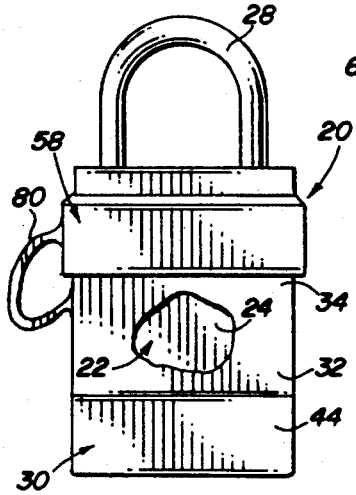
FIG. 1
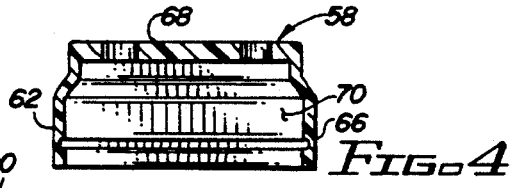
FIG. 4
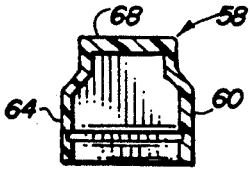
FIG. 6
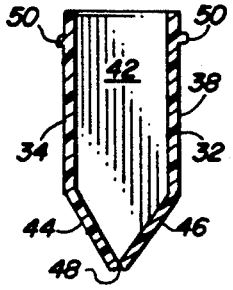
FIG. 2
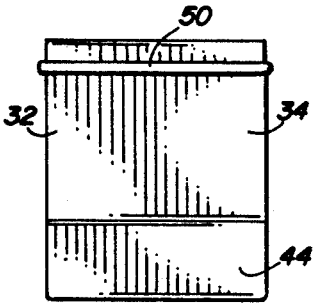
FIG. 3
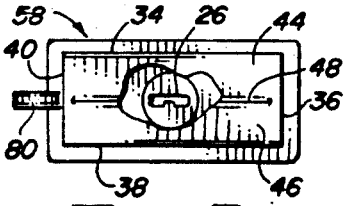
FIG. 5
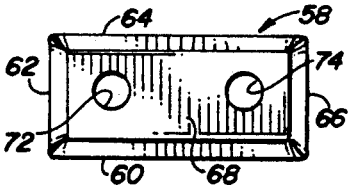
FIG. 7
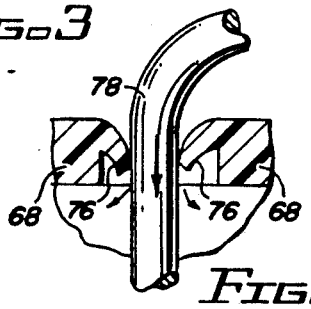
FIG. 8
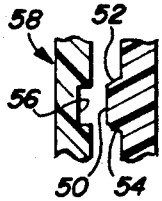
FIG. 10
FIG. 11
FIG. 9
FIG. 16
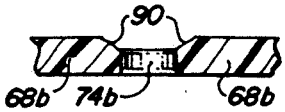
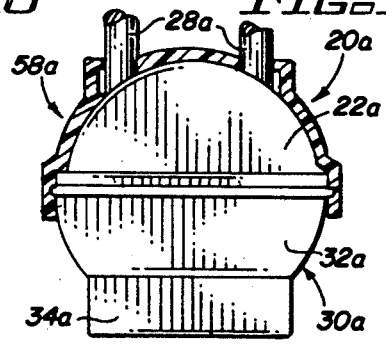
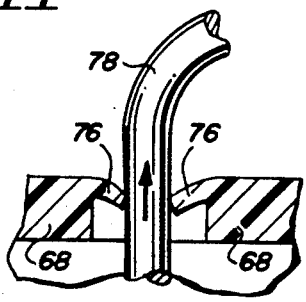
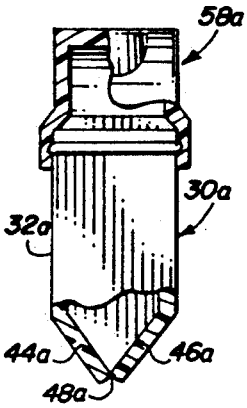
FIG. 12
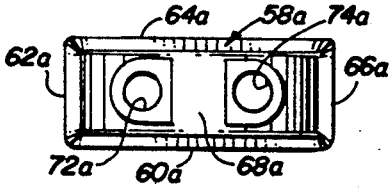
FIG. 13
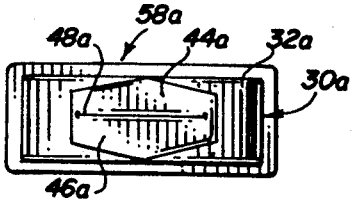
FIG. 14
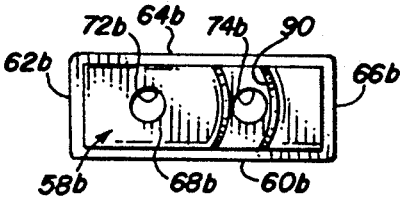
FIG. 15

LOCK AND PROTECTIVE COVER ASSEMBLY

BACKGROUND OF THE INVENTION

1. Field of the Invention

The present invention generally relates to locks and, more particularly, to an improved lock and protective cover assembly.

2. Prior Art

A number of covers have been devised to protect locks against the elements. For the most part, such covers have been made of non-corrodable metal, such as aluminum or magnesium, or of relatively stiff and inflexible plastic to seal off the locks from moisture, dirt, rusting and the like. Such covers are normally comprised of two or more hinged or snapped together pieces. See, for example, U.S. Pat. No. 4,317,344 wherein there are disclosed a pair of top and bottom boots which clamp together over the lock body. In U.S. Pat. No. 3,848,440, a similar construction is disclosed with a lid snap fitted to a bottom casing. U.S. Pat. No. 3,858,419 discloses a similar arrangement, as do U.S. Pat. Nos. 4,224,813 and 3,983,725. U.S. Pat. Nos. 4,134,280, 4,286,445 and 4,218,902 are also similar.

In each instance, two or more portions of the protective casing must be pulled apart or a hinged trap door therein must be opened in order to permit access to the lock keyhole for operation of the lock. Such devices tend to become very brittle and stiff in use, so that their components become difficult to separate and reassemble and have a tendency to wear rapidly. This is particularly true when the ambient temperature is very low, as in the winter in northern climates. Moreover, such devices require complicated fabricating techniques and are relatively expensive.

Accordingly, it would be desirable to provide an improved lock and cover assembly wherein the cover is easy to install and to remove and is inexpensive, durable and efficient in all kinds of weather to fully protect the lock. Such cover should be capable of being made in a single molding operation or simple forming operation and be unitary in structure.

An assembly which overcomes most of the foregoing defects is set forth in U.S. Pat. No. 4,651,543. In that patent, a one-piece stretchable cover is disclosed which is stretched over a lock and which provides an openable bottom slit. The cover is intended to be left in place and is somewhat difficult to install over a lock, unless it is made very loose and/or highly elastic. Its elasticity may be so reduced with age and weathering that it cannot be removed from the lock for oiling and repair of the lock, etc., without ripping and destroying the cover.

Accordingly, there remains a need for a simplified easily installable and removable lock cover which will allow periodic inspection and oiling of a lock while retaining the integrity and weather-sealing capability of the cover. Such cover should be flexible and resilient but should not require extreme stretchability in order to be easily installed on and removed from the lock.

SUMMARY OF THE INVENTION

The improved lock and protective assembly of the present invention satisfies all the foregoing needs. The assembly is substantially as set forth in the Abstract above. Thus, it includes a lock, the body of which is wholly enclosed in a flexible, resilient, stretchable two-piece casing up from which the lock hasp or shackle loop protrudes. The casing extends well below the lock and includes a bottom portion with a bottom normally closed slit which is automatically openable merely by squeezing two opposed sides of the casing lower portion at opposite ends of the slit towards each other, thus permitting a key to be inserted through the slit into the keyhole. Upon removal of the key, the slit automatically relaxes to the closed position.

The casing or cover has a cap containing two spaced hasp holes. The holes have circumferential downwardly and inwardly sloping extensions extending thereinto, in order to effectively weather seal the hasp holes. Moreover, the cap is releasably attached to the bottom portion of the cover by an annular groove in the inside of the cap engageable with and into which wedgingly fits a circumferential head having a tapered top and bottom on the overlapped part of the lower portion of the cover to weather seal the two pieces of the cover together. The cover is shaped to fit a flat rectangular or square or circular lock. In the latter case the cap top is horizontal; that is, flat in the areas defining the hasp holes. The cap top may also have an arcuate groove thereacross intersecting one of the hasp holes so that the free end of the hasp can be swung in an arc over the cap before engaging an item to be locked, that is, in unlocking or locking the lock and moreover, the two pieces of the cover can be tied together for convenience sake by a flexible cord.

Further features of the assembly of the present invention are set forth in the following detailed description and accompanying drawings.

DRAWINGS

FIG. 1 is a schematic front elevation, partly broken away, of a first preferred embodiment of the improved lock and cover assembly of the present invention;

FIG. 2 is a schematic vertical side cross-section of the bottom portion of the cover of FIG. 1;

FIG. 3 is a schematic front elevation of the bottom portion of the cover of FIG. 1;

FIG. 4 is a schematic vertical frontal cross-section of the cap of the cover of FIG. 1;

FIG. 5 is a schematic bottom plan view, partly broken away, of the assembly of FIG. 1;

FIG. 6 is a schematic vertical side cross-section of the cap of FIG. 1;

FIG. 7 is a schematic top plan view of the cover of FIG. 1;

FIG. 8 is an enlarged, fragmentary schematic view, partly in section, of a hasp hole of the cover of FIG. 1 as a hasp is urged downwardly therethrough;

FIG. 9 is an enlarged, fragmentary schematic view, partly in section, of the hasp hole of FIG. 8 as the hasp is urged upwardly therethrough;

FIG. 10 is an enlarged, fragmentary schematic vertical cross-section of a portion of the cover of FIG. 1 which includes the bead and bead-receiving groove;

FIG. 11 is a fragmentary, schematic front elevation, partly in section, and partly broken away, of a second preferred embodiment of the improved lock and cover assembly of the present invention;

FIG. 12 is a schematic vertical end cross-section of the cover of the assembly of FIG. 11;

FIG. 13 is a schematic top plan view of the cover of FIG. 11;

FIG. 14 is a schematic bottom plan view of the cover of FIG. 11;

FIG. 15 is a schematic top plan view of a third preferred embodiment of the improved cap of the present invention; and, FIG. 16 is an enlarged fragmentary schematic vertical cross-section through the arcuate groove and associated hasp hole area of the cap of FIG. 15.

DETAILED DESCRIPTION

FIGURES 1-10

Now referring more particularly to FIGS. 1-10 of the drawings, a first preferred embodiment of the improved lock and cover assembly of the present invention is schematically depicted therein. Thus, assembly 20 is shown which comprises a generally rectangular lock 22 having a main lock body 24 with a bottom keyhole 26 (FIG. 5) and an inverted, U-shaped two rung hasp 28 extending up from body 24.

Body 24 is completely enclosed in a cover 30 comprising a relatively thin, flexible, resilient two piece casing of material such as synthetic rubber or elastomeric plastic, or polyurethane plastic or other material which is weather-resistant. Cover 30 is sufficiently flexible so that it can be slightly deformed in fitting lock body 24 therein and putting hasp 28 in the correct location. In this regard, cover 30 comprises a lower portion 32 defined by spaced interconnected vertical sidewalls 34, 36, 38 and 40 defining a central space 42.

The sidewalls 34 & 38 slope toward each other in their lower parts 44 and 46, respectively, to meet at the bottom of portion 32 to define a normally closed slit 48 communicating with space 42. Parts 44 and are below lock body 24. Slit 48 may be opened by squeezing sidewalls 36 and 40 toward each other, so that access can readily be made to keyhole 26 for locking and unlocking lock 22.

It will be noted that the outer surface of portion 32 includes a horizontal bead 50 adjacent the upper end of portion 32, which bead, as shown in FIG. 10, has tapered down top and bottom portions 52 and 54, respectively. Bead 50 wedgingly engages a circumferential horizontal groove 56 in the lower part of the inner surfaces of removable cap 58, which forms the second of the two pieces comprising cover 30. Groove 56 and bead 50 releasably hold cap 58 to portion 32.

Cap 58 is formed of four interconnected stepped sidewalls 60, 62, 64 and 66 joined by a horizontal top 68 defining therewith a central space 70. A pair of vertical hasp holes 72 and 74 (FIG. 7) in top 68 provide access to space 70 within which the upper part of lock 22 is stored.

The lower part of sidewalls 60, 62, 64 & 66 overlap the upper part of portion 32 and include groove 56. It will be noted that the diameter of groove 56 is slightly less than that of the base portion of bead 50 so that bead 50 wedgingly seals in groove 56 for a tight weatherproof fit. Accordingly, portion 32 can be easily removed from cap 58 to allow lock body 24 to be installed therein and then can be easily resealed thereto. When it is needed to oil, inspect or replace lock 22, portion 32 can be easily removed from cap 58. This all can be done without stretching cover 30.

The portions of top 68 defining hasp holes 72 and 74 bear downwardly and inwardly projecting circumferential, resilient, flexible extensions or flaps 76 which act as seals against the rungs 78 of hasp 28. As rung 78 is pushed down relative to extension 76 (FIG. 8), extension 76 is biased downwardly and outwardly, but still grips the perimeter of rung 78. As rung 78 is pulled up (as when lock 22 is hung in place) extension 76 is compressed more tightly up against the perimeter of rung 78 for a weatherproof seal. Cap 58 is tethered to portion 32 by a resilient cord 80 which may be integral therewith.

Accordingly, assembly 20 has many advantages, due to cover 30 which is durable, inexpensive and weathertight, and which can be more readily installed and removed than prior art lock covers.

FIGURES 11-14

A second preferred embodiment of the improved lock and cover assembly of the present invention is schematically depicted in FIGS. 11-14. Thus, assembly 20*a* is shown. Components thereof similar to those of assembly 20 bear the same numerals but are succeeded by the letter "a". Assembly 20*a* differs from assembly 20 only in that lock 20*a* is circular in front elevation and rectangular in side elevation, and thus cover 30, including cap 58 and portion 32, is also generally circular in front elevation. Top 68 is upwardly curved in its central portion but horizontal in the parts thereof defining vertical holes 72*a* and 74*a*. Parts 44*a* and 46*a* converge to form slit 48*a*, similar to parts 44 and 46, and slit 48. Moreover, cover 30*a* has no cord such as cord 80. Assembly 20*a* has substantially the advantages of assembly 20.

FIGURES 15 and 16

A third preferred embodiment of the cap used in the assembly of the present invention is schematically depicted in FIGS. 15 and 16. Thus, cap 58*b* is shown, which can be fully substituted for cap 58 in assembly 20 and which differs from cap 58 only in having an arcuate groove 90 in top 68*b*, which groove 90 provides better clearance for top 68*a*. Thus, groove 90 extends from side 60*b* to side 64*b* and surrounds hasp hole 74*b*, so that the free ends of the hasp rung (not shown) can be moved along groove 90 without touching and gauging top 68*b* during locking and unlocking of lock 22.

Various other modifications, changes, alterations and additions can be made in the improved lock and cover assembly of the present invention and in their components and parameters. All such modifications, changes, alterations and additions as are within the scope of the appended claims form part of the present invention.

What is claimed is:

1. The method of providing a positive seal between a lock cover and a lock, wherein said lock comprises a main body and an inverted u-shaped top hasp connected to the top of said main body and extending upwardly therefrom, which lock is secured in a closed position by first depressing said hasp towards said main body in a first direction and allowing said hasp to return away from said main body in a direction directly opposite said first direction, comprising the steps of, a) providing a flexible cover with a plurality of openings therein for receiving said hasp therein, b) insuring that said openings are significantly smaller when at rest than the cross-section of said hasp, c) passing said hasp through said openings in said first direction while expanding said openings by forcing the area immediately adjacent to and defining said openings in said first direction; and, d) allowing said hasp to move a short distance in said direction opposite said first direction, thereby moving said lock to substantially its at-rest position, such that said area defining said openings is forced in said second direction and inward toward the hasp, creating a greater pressure between said hasp and said area defining said openings, wherein a relatively tight seal is effected between said openings and said hasp.

2. An improved lock and protective cover assembly, said assembly comprising, in combination:

a) a lock having:

i. a lock main body with a bottom keyhole; and ii. an inverted U-shaped top hasp connected to the top of said main body and extending upwardly therefrom; and, b) a flexible, resilient, stretchable protective cover removably enclosing and sealing said lock body against the elements, said cover comprising:

i. a bottom portion extending over the lower sides of said main lock body and below thereof comprising opposed sides and including a tapered bottom defining a closed slit aligned below said keyhole and automatically openable by squeezing said opposed sides towards each other, the exterior of said bottom portion including an external circumferential bead around thereabout; and, ii. an upper cap comprising a top and interconnected depending sides releasably disposed over, respectively, the top and upper sides of said main lock body and defining top hasp openings for sealingly gripping a hasp, and a circumferential groove around the interior surface of said cap sides adapted to releasably engage said bead to sealingly hold said cap to said bottom portion to prevent moisture from entering the interior of said cover, c) wherein said cap has an arcuate depression extending thereacross with one of said hasp openings centered therein, whereby the free end of said hasp can be rotated through said depression, in locking and unlocking said lock, without touching said top.

3. The improved assembly of claim 2 wherein the portions of said cap top defining said hasp openings include circumferential flexible extensions projecting inwardly to define said hasp openings, said hasp openings being significantly smaller than the cross-section of said hasps, whereby movement of said hasp into said openings compresses said extensions for improved weatherproof sealing between the hasp and the cap top.

4. The improved assembly of claim 3 wherein said extensions are integral with said cap top.

5. The improved assembly of claim 2 wherein said lock is generally circular in front elevation, said cap and bottom portion each being generally semi-circular in front elevation, with the portions of said cap defining said hasp openings being generally horizontal, said hasp openings being generally vertical, and with the lower end of said bottom portion tapering down to said bottom slit.

6. The improved assembly of claim 2 wherein said cap and bottom portion of said cover are interconnected by a flexible cord.

7. The improved assembly of claim 2 wherein said cover is one of elastomeric rubber and elastomeric plastic.

8. A protective cover assembly for a lock having a main body with a bottom keyhole and an inverted U-shaped top hasp connected to the top of the main body and extending upwardly therefrom, comprising:

i. a bottom portion extending over the lower sides of said main lock body and below thereof comprising opposed sides and including a tapered bottom defining a closed slit aligned below said keyhole and automatically openable by squeezing said opposed sides towards each other, the exterior of said bottom portion including an external circumferential bead around thereabout; and, ii. an upper cap comprising a top and interconnected depending sides releasably disposed over, respectively, the top and upper sides of said main lock body and defining top hasp openings for sealingly gripping a hasp, and a circumferential groove around the interior surface of said cap sides adapted to releasably engage said bead to sealingly hold said cap to said bottom portion to prevent moisture from entering the interior of said cover, iii. wherein said cap has an arcuate depression extending thereacross with one of said hasp openings centered therein, whereby the free end of said hasp can be rotated through said depression, in locking and unlocking said lock, without touching said top.

9. The improved assembly of claim 8 wherein the portions of said cap top defining said hasp openings include circumferential flexible extensions projecting inwardly to define said hasp openings, said hasp openings being significantly smaller than the cross-section of said hasps, whereby movement of said hasp into said openings compresses said extensions for improved weatherproof sealing between the hasp and the cap top.

10. The improved assembly of claim 9 wherein said extensions are integral with said cap top.

11. The improved assembly of claim 8 wherein said lock is generally circular in front elevation, said cap and bottom portion each being generally semi-circular in front elevation, with the portions of said cap defining said hasp openings being generally horizontal, said hasp openings being generally vertical, and with the lower end of said bottom portion tapering down to said bottom slit.

12. The improved assembly of claim 8 wherein said cap and bottom portion of said cover are interconnected by a flexible cord.

13. The improved assembly of claim 8 wherein said cover is one of elastomeric rubber and elastomeric plastic.

* * * * *